US005876234A

United States Patent [19]

Hester

[11] Patent Number: 5,876,234

[45] Date of Patent: Mar. 2, 1999

[54] SECURING APPARATUS FOR AN ELECTRICAL MALE/FEMALE CONNECTION

[76] Inventor: John C. Hester, 485 Bridgewater Ct., Mary Esther, Fla. 32569

[21] Appl. No.: 832,539

[22] Filed: Apr. 3, 1997

[51] Int. Cl.[6] ..... H01R 13/62

[52] U.S. Cl. ..... 439/369

[58] Field of Search ..... 439/367, 369, 439/371, 370

[56] References Cited

U.S. PATENT DOCUMENTS

| | | | |
|---|---|---|---|
| 3,999,828 | 12/1976 | Howell | 439/369 |
| 4,832,618 | 5/1989 | Gunderson | 439/369 |
| 5,167,524 | 12/1992 | Falcon et al. | 439/369 |
| 5,584,720 | 12/1996 | Elswick | 439/369 |

*Primary Examiner*—Hien Vu
*Assistant Examiner*—Yong Ki Kim
*Attorney, Agent, or Firm*—George A. Bode; Lisa D. Charouel; Bode & Associates

[57] ABSTRACT

A securing apparatus for an electrical male/female connection comprising a first band member, a second band member and a flexible connecting member. The first band member comprises a top portion having formed therein two parallel slits for forming a first flexible surface area. The second band member comprises a top portion having formed therein two parallel slits for forming a second flexible surface area. The flexible connecting member has one distal end coupled to a distal end of the first flexible surface area and the other distal end coupled to the second flexible surface area.

2 Claims, 2 Drawing Sheets

SECURING APPARATUS FOR AN ELECTRICAL MALE/FEMALE CONNECTION

This invention is disclosed in Disclosure Document No. 402,905 filed Jul. 15, 1996.

BACKGROUND OF THE INVENTION

1. Field of the Invention

The present invention relates to a securing apparatus for an electrical male/female connection and, more particularly, to a securing apparatus for an electrical male/female connection for maintaining the friction fit between an electrical male plug and an electrical female connector.

2. General Background

Typically, extension cords are used for extending the distance of electrically powered devices. Extension cords are readily used at construction sites and in the home. However, the male/female connection between the electrically powered device and an extension cord is maintained by a friction fit between the mating connection of the male electric plug of the electrically powered device and the female connector of the electrical extension cord. However, on occasion the friction fit for maintaining the connection between the male electric plug of the extension cord and the female connector of the electrically powered device becomes insufficient and the male/female connection becomes disconnected thereby preventing electrical power from flowing to the electrically powered device. The user will then reconnect the male/female connection. This is time consuming and bothersome when a user has a job to perform.

Several devices have been patented which are aimed at securing apparatuses for male/female connections.

U.S. Pat. Nos. 4,869,683, by Nelson, 5,147,216, by Shotey, and 5,273,454, by Shotey, are directed to protective enclosures for protectively enclosing a male/female connection from adverse weather conditions and particularly water. Each of the ends of the protective enclosures have binding straps wrapped around the protective enclosures for gripping the electrical cords for completely enclosing the male/female connections.

U.S. Pat. No. 5,443,397, by Carl, is directed to a restraining apparatus having two band members and two flexible members joining the two band members together for maintaining the male/female connection between a male electrical plug and a female electrical connector. The apparatus, by Carl, doesn't easily allow the insertion of the electrical cords and doesn't accommodate a variety of circumferences or shapes of the electrical cords.

U.S. Pat. No. 5,179,044, by Muromachi et al., is directed to an elongated elastic member which wraps around the end of the male plug and the female connector for applying a force of pressure to maintain the male/female connection.

U.S. Pat. No. 5,167,524, by Falcon et al., is directed to restraints coupled via VELCRO for maintaining the male/female connection. The apparatus, by Falcon et al., does not teach quasi-cylindrical shaped bands or cylindrical shaped bands having slits formed therein, as does the present invention.

Other patents present in the art are U.S. Pat. No. 4,097,105, by Zumwalt, and U.S. Pat. No. 2,725,543, by Tanner, of which are directed to securing apparatuses for an electrical male/female connection, but do not meet the needs of the apparatus of the present invention.

SUMMARY OF THE PRESENT INVENTION

The preferred embodiment of the securing apparatus for an electrical male/female connection of the present invention solves the aforementioned problems in a straight forward and simple manner. What is provided is a securing apparatus for an electrical male/female connection for maintaining the friction fit between an electrical male plug and an electrical female connector.

The securing apparatus for an electrical male/female connection comprises a first band member, a second band member and a flexible connecting member. The first band member comprises a top portion having formed therein two parallel slits for forming a first flexible surface area. The second band member comprises a top portion having formed therein two parallel slits for forming a second flexible surface area. The flexible connecting member has one distal end coupled to a distal end of the first flexible surface area and the other distal end coupled to the second flexible surface area.

In view of the above, it is an object of the present invention to provide quasi-cylindrically shaped bands each having inwardly inclined first and second bottom members separated by a slit. The inwardly inclined first and second bottom members prevent the diameter of each of the quasi-cylindrically shaped bands from being distorted when the electrical cord is forced through the width of the slit.

It is a further object of the present invention to provide such a securing apparatus for an electrical male/female connection which is not compromised with the repeated use thereof.

It is a further object of the invention to provide the bands with two parallel slits spaced apart by a distance wherein the surface area between the two parallel slits unitarily couples to the flexible connecting member such that the flexible connecting member and the unitarily coupled surface areas conform to the height and/or contour of the male plug housing and the female connector housing.

It is a further object of the invention to provide each of the bands with a tie member for closing the slit formed in each band thereby preventing the electrical cords from exiting the hollow interior of the bands.

In view of the above objects it is a feature of the present invention to provide a securing apparatus for an electrical male/female connection which is simple to use, inexpensive and easy to manufacture.

It is another feature of the present invention to provide a securing apparatus for an electrical male/female connection which made of plastic such as a thermoplastic rubber resin.

The above objects and other features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
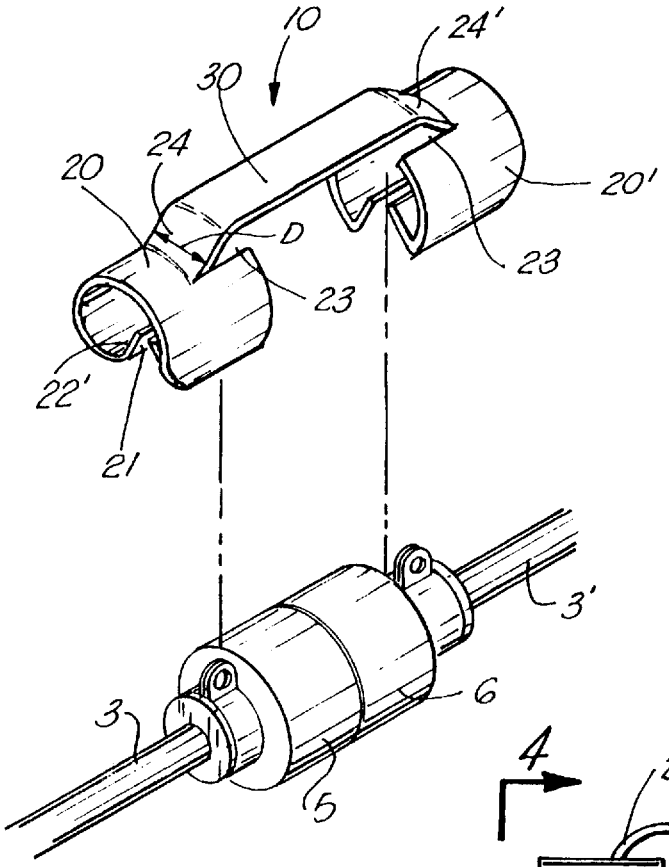
FIG. 1 is a perspective view of the preferred embodiment of the securing apparatus for an electrical male/female connection of the present invention.
Figure 4:
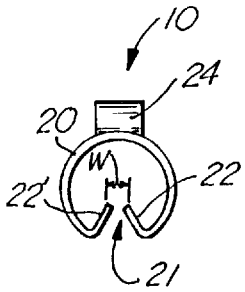
FIG. 4 is an end view of the embodiment of FIG. 3 along the plane of 4—4.
Figure 3:
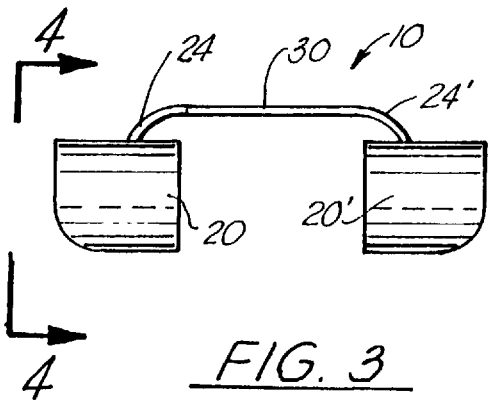
FIG. 3 is a side view of the embodiment of FIG. 1.
Figure 2:
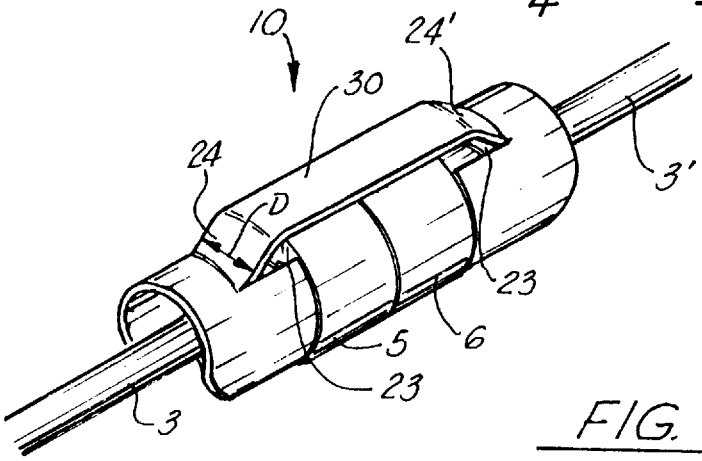
FIG. 2 is a perspective view of the embodiment of FIG. 1 deployed in use.

Referring now to the drawing, and in particular FIGS. 1–4, the securing apparatus for an electrical male/female connection of the present invention is designated generally by the numeral 10. Securing apparatus for an electrical male/female connection 10 is generally comprised of bands 20 and 20' and flexible connecting member 30.

Bands 20 and 20' are quasi-cylindrically shaped bands. Since bands 20 and 20' are identical, only one such band will be described in detail. The bottom portion of quasi-cylindrically shaped band 20 comprises slit 21 having width W extending along the length of said bottom portion thereby forming first and second bottom members 22 and 22'. First and second bottom members 22 and 22' are inwardly inclined into the interior of quasi-cylindrically shaped band 20 so that electrical cord member 3 is forced through width W of slit 21. The inwardly inclined first and second bottom members 22 and 22' provide a conduit of snapping electrical cord member 3 into the hollow interior of quasi-cylindrically shaped band 20 thereby simplifying the attachment of electrical cord member 3. The width of electrical cord member 3 applies a force of pressure to inwardly inclined first and second bottom members 22 and 22' thereby increasing width W for snapping electrical cord member 3 into place. Furthermore, the inwardly inclined first and second bottom members 22 and 22' do not distort the diameter of quasi-cylindrically shaped band 20 as width W is increased by said force of pressure. Henceforth, the integrity of securing apparatus for an electrical male/female connection 10 is not compromised with repeated use thereof.

The top portion of quasi-cylindrically shaped band 20 comprises two parallel slits 23 extending along a portion of said top portion wherein the two parallel slits 23 are spaced apart by distance D. Surface area 24 within the confines of the two parallel slits 23 is flexible and conforms to the height and/or contour of male plug housing 5. One distal end of surface area 24 flexibly pivots upward from the surface of quasi-cylindrically shaped band 20. The other distal end of surface area 24 unitarily couples to one distal end of flexible connecting member 30.

The other distal end of flexible connecting member 30 unitarily couples to one distal end of surface area 24' of quasi-cylindrically shaped band 20'. Surface area 24' is flexible and conforms to the height and/or contour of female connector housing 6. The other distal end of surface area 24' flexibly pivots upward from the surface of quasi-cylindrically shaped band 20'. The two parallel slits 23 of bands 20 and 20' in combination with flexible connecting member 30 enhance the flexibility of flexible connecting member 30 and the biasing of the male/female connection for a variety of shapes and sizes of male plug housing 5 and female connector housing 6.

The following will describe the operation of securing apparatus for an electrical male/female connection 10. Securing apparatus for an electrical male/female connection 10 may be first placed on either electrical power cord members 3 or 3'. For exemplary purposes, the operation will be described in relation to placing band 20 on electrical power cord member 3. Quasi-cylindrically shaped band 20 is snapped onto electrical power cord member 3 having male plug housing 5 attached to its end. Flexible connecting member 30 in combination with flexible surface area 24 flex to the height and/or contour of male plug housing 5. Male plug housing 5 and female connector housing 6 are mated together to form the male/female connection. Quasi-cylindrically shaped band 20' is snapped onto electrical power cord member 3'. As quasi-cylindrically shaped band 20' is snapped onto electrical power cord 3', flexible connection member 30 in combination to flexible surface area 24' flex to the height and/or contour of female connector housing 6; henceforth, male plug housing 5 and female connector housing 6 are thereafter biased toward each other for maintaining the male/female connection.

Figure 5:
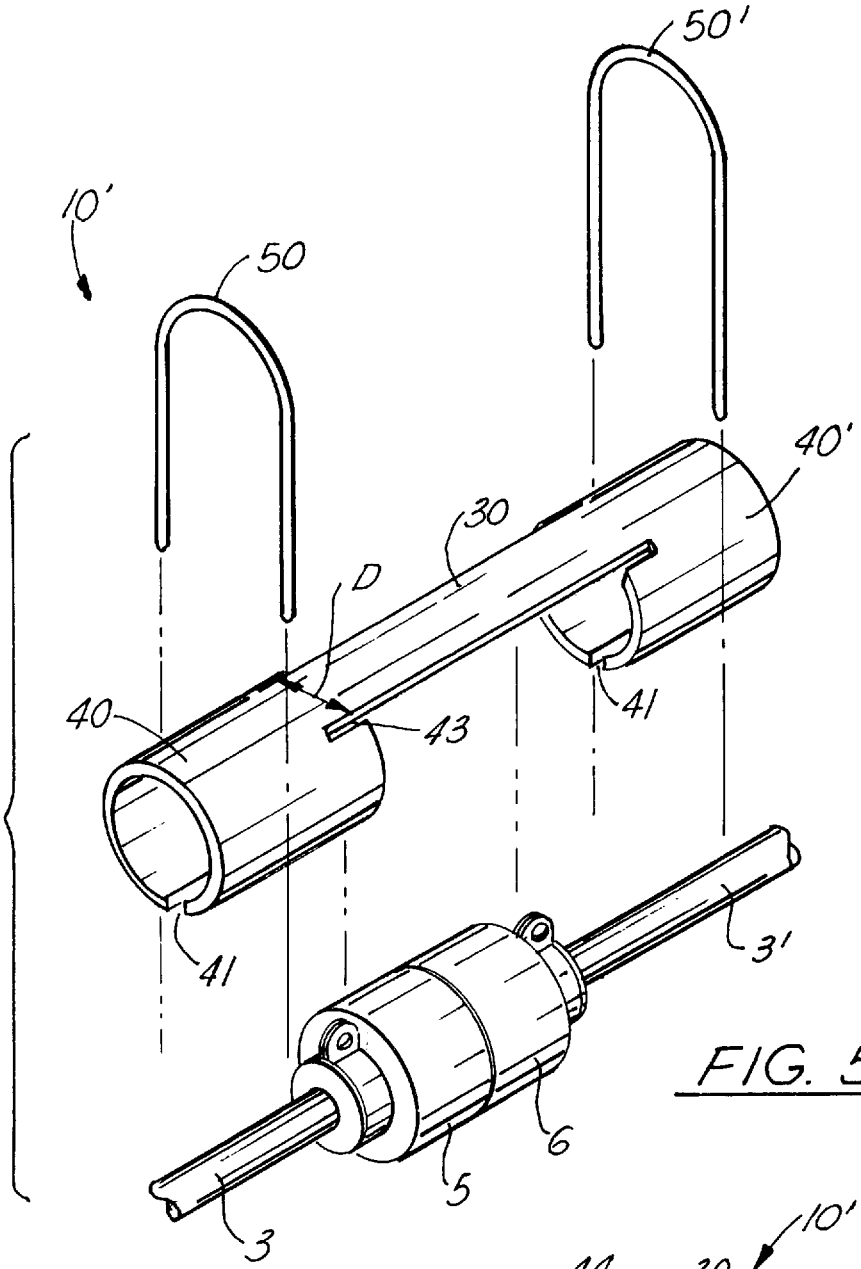
FIG. 5 is a perspective view of an alternate embodiment of the securing apparatus for an electrical male/female connection of the present invention.
Figure 6:
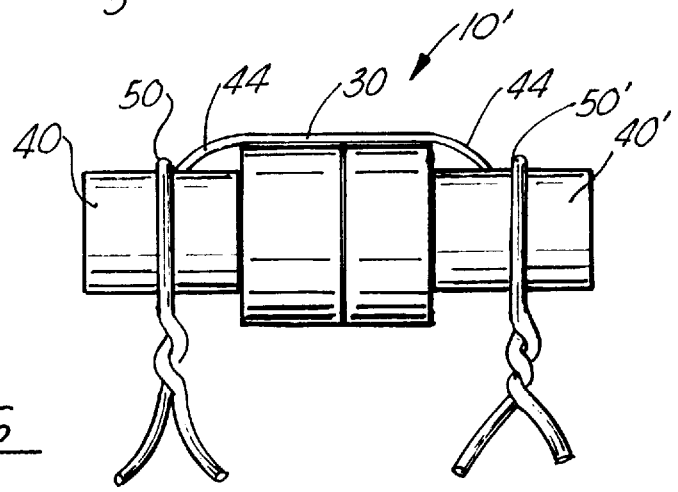
FIG. 6 is a side view of the alternate embodiment of the securing apparatus for an electrical male/female connection of the present invention shown in FIG. 5 deployed in use.

Referring to FIGS. 5 and 6, an alternative embodiment of securing apparatus for an electrical male/female connection 10' of the present invention is illustrated. Securing apparatus for an electrical male/female connection 10' comprises bands 40 and 40', flexible connecting member 30 and band tie means 50 and 50'.

Since bands 40 and 40' are identical, only one such band will be described in detail. Band 40 is a cylindrical shaped band having slit 41 formed along the length of the bottom portion of band 40. Electrical power cord members 3 is forced through slit 41 and into the hollow interior of cylindrical shaped band 40.

The top portion of cylindrically shaped band 40 comprises two parallel slits 43 extending along a portion of said top portion wherein the two parallel slits 43 are spaced apart by distance D. Surface area 44 within the confines of the two parallel slits 43 is flexible and conforms to the height and/or contour of male plug housing 5. One distal end of surface area 44 flexibly pivots upward from the surface of cylindrically shaped band 40. The other distal end of surface area 44 unitarily couples to one distal end of flexible connecting member 30.

Band tie means 50 and 50', respectively, are wrapped around cylindrically shaped bands 40 and 40', respectively. The free ends of band tie means 50 and 50' are twisted for tieing band tie means 50 and 50' around cylindrically shaped bands 40 and 40' wherein the widths of slits 41 are reduced for preventing electrical cord members 3 and 3' from exiting the hollow interior of cylindrically shaped bands 40 and 40', respectively.

In the exemplary embodiments, the diameter of bands 20, 20', 40 and 40' are greater than the diameter of electrical power cord members 3 and 3' but less than the outer perimeter of male plug housing 5 and female connector housing 6, respectively. Bands 20, 20', 40 and 40' and flexible connecting members 30 and 50 are made of plastic such as thermoplastic rubber resins or the like.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A securing apparatus for an electrical connection between a male and female electrical connector, said securing apparatus comprising:

(a) a first band member comprising a top portion having formed therein two parallel slits for forming a first flexible surface area;

(b) a second band member comprising a top portion having formed therein two parallel slits for forming a second flexible surface area, wherein said first band member and said second band member are quasi-cylindrically shaped, and wherein each of said first band member and said second band member further comprises:

(i) a bottom portion having a slit extending along the length of said bottom portion for forming a first bottom member; and, (ii) a second bottom member wherein said first bottom member and said second bottom member are inwardly inclined into the interior of said first band member and said second band member; and, (c) flexible connecting member having one distal end coupled to a distal end of said first flexible surface area and the other distal end coupled to said second flexible surface area.

2. A securing apparatus for an electrical connection between a male and female electrical connector, said securing apparatus comprising:

(a) a quasi-cylindrically shaped first band member comprising a top portion having formed therein two parallel slits for forming a first flexible surface area;

(b) a quasi-cylindrically shaped second band member comprising a top portion having formed therein two parallel slits for forming a second flexible surface area, wherein each of said first band member and said second band member further comprises:

(i) a bottom portion having a slit extending along the length of said bottom portion for forming a first bottom member; and, (ii) a second bottom member wherein said first bottom member and said second bottom member are inwardly inclined into the interior of said first band member and said second band member; and, (c) flexible connecting member having one distal end coupled to a distal end of said first flexible surface area and the other distal end coupled to said second flexible surface area.

* * * * *